United States Patent [19]

Thomas et al.

[11] Patent Number: 4,671,827

[45] Date of Patent: Jun. 9, 1987

[54] METHOD OF FORMING HIGH-STRENGTH, TOUGH, CORROSION-RESISTANT STEEL

[75] Inventors: Gareth Thomas, Berkeley, Calif.; Nack J. Kim, Florham Park, N.J.; Ramamoorthy Ramesh, Berkeley, Calif.

[73] Assignee: Advanced Materials and Design Corp., Berkeley, Calif.

[21] Appl. No.: 786,623

[22] Filed: Oct. 11, 1985

[51] Int. Cl.[4] ..... C21D 8/00; C22C 38/18

[52] U.S. Cl. ..... 148/12 E; 148/12 F; 148/12.1; 148/12.4; 148/333; 148/325

[58] Field of Search ..... 148/12 E, 12 F, 12.1, 148/12.4, 36, 37

[56] References Cited

U.S. PATENT DOCUMENTS

| | | | |
|---|---|---|---|
| 3,385,740 | 5/1968 | Braggstrom et al. | 148/38 |
| 4,170,497 | 10/1979 | Thomas et al. | 148/36 |
| 4,533,401 | 8/1985 | Yutori et al. | 148/12.4 |

FOREIGN PATENT DOCUMENTS

| | | | |
|---|---|---|---|
| 1188574 | 4/1970 | United Kingdom | 148/12 F |

*Primary Examiner*—Melvyn J. Andrews
*Assistant Examiner*—Deborah Yee
*Attorney, Agent, or Firm*—Flehr, Hohbach Test, Albritton & Herbert

[57] ABSTRACT

A high-strength, tough alloy steel is formed by heating an alloy steel comprising iron, 0.1–0.4 weight % carbon, 1–3 weight % manganese and 1–13 weight % chromium and optionally containing microalloying amounts of other metals to about 1150° C. to form a stable homogeneous austenite phase, control rolling the steel at about 900° C.–1100° C., followed by rapid cooling to 950° C. and again rolling at that temperature and then quenching the thusly rolled steel in liquid or by air cooling. Tempering at temperatures up to about 300° C. may be effected to further increase the toughness of the steel.

7 Claims, 15 Drawing Figures

METHOD OF FORMING HIGH-STRENGTH, TOUGH, CORROSION-RESISTANT STEEL

BACKGROUND OF THE INVENTION

The present invention relates to a process for obtaining high-strength, composite martensitic/austenitic iron-chromium-manganese-carbon steel alloys. These steels find extensive use in the production of plates, rounds, chains, and the like, in plates for the mining and agricultural industries, in ordnance and as pressure vessel steels in the nuclear and chemical process industries. The high strength of the alloys in combination with other attractive properties such as corrosion and oxidation resistance yields a steel which has excellent potential as a high technology material.

The desired microstructural condition of a particular steel depends very much on the intended end use of the steel. For example, in the fossil fuel industry, where temperatures on the order of 500° C. are quite normal, resistance to creep, oxidation, corrosion and catastrohic intergranular embrittlement is necessary. Therefore, in such an application the steel is often used in the 650° C. tempered condition. In contrast, in the mining industry and in military applications, e.g., armored plates, room temperature and lower temperature properties are of much greater concern, and thus, strength and toughness become more critical parameters for such a steel. In addition, improved toughness and hardness improve wear resistance which is important in mining and agriculture. In seeking to attain these desired properties, the problem is complicated when the alloy content of structural steels is increased, because there is a tendency towards lower toughness values, especially if the steel is untempered. There is thus a need to attain for certain applications a high-strength steel, while still using high-alloy content to improve corrosion resistance.

A high-strength, ternary iron-chromium-carbon steel is disclosed in J. McMahon and G. Thomas, *Proc. Third Intern. Conf. on the Strength of Metals and Alloys,* Cambridge, Inst., Metals, London, 1, p. 180 (1973). An iron/0.35 weight % carbon/4 weight % chromium alloy is disclosed exhibiting a Charpy-V-Notch value of 12–15 ft/lbs and a plane strain fracture toughness ($K_{Ic}$) of about 70 KSI-in$^{\frac{1}{2}}$.

A further improvement in steel alloys is disclosed in U.S. Pat. Nos. 4,170,497 and 4,170,499 wherein a third alloying element (which is an austenite stabilizer, such as nickel or manganese) is added to increase the toughness and the stability of the austenite films. These patents also describe heat treatment processes for grain refining. By contrast, according to the present invention an object is to effect grain refining of the composite structure by refining the grain and packet size without disturbing the essential features of the autotempered lath martensite surrounded by stable austenite films, while at the same time increasing the chromium content to up to 13% to effect improved corrosion resistance.

SUMMARY OF THE INVENTION

In accordance with the present invention, a high-strength, high-toughness, high-chromium martensitic steel is formed when a steel possessing a composition of 0.1–0.4% carbon, 1–13% chromium and 1–3% manganese (with or without nickel and microalloying amounts of molybdenum, niobium, vanadium, and the like) is controlled rolled in the austenitic region.

This process comprises the steps of:

(a) heating a steel alloy comprising 0.1 to 0.4 weight % carbon, 1 to 3 weight % manganese and 1 to 13 weight % chromium and the remainder of iron to a temperature above the austenite transformation temperature to form a stable, homogeneous austenite phase;

(b) control rolling said austenite phase at a temperature in the range of about 900° C. to 1100° C. with a reduction of not less than 30% in area to form a microstructure of uniformly dispersed ultrafine austenite grains;

(c) rapidly cooling the rolled steel from step (b) to 950° C.;

(d) rolling the cooled steel from step (c) with a reduction of not less than 40% in area to further reduce the size of said grains; and (e) quenching the rolled steel from step (d) in liquid or air to produce high-strength steel characterized by a room temperature Charpy impact strength of at least about 40 ft/lbs, a plane strain fracture toughness ($K_{Ic}$) of at least about 80 ksi-in.$^{\frac{1}{2}}$ and a Rockwell C-scale hardness of at least about 46.

The microstructure of the steel made in accordance with the present invention consists of uniformly dispersed martensitic laths, which are separated by thin sheets of retained austenite and which have good connectivity. The lath structure is dispersed with fine autotempered carbides. The retained austenite films are stable up to about 350° C., after which they transform to cementite and lace the lath boundaries. According to the process of the present invention, there is considerable reduction in grain size when compared to an unprocessed steel austenitized at the same temperature. As a result of the strong effect of the grain size on the strength and toughness (Hall-Petch relationship), and the favorable microstructure, the steel product according to the present invention is characterized by an excellent combination of high Charpy impact toughness, strength on the order of, or higher than, the unprocessed steel, and ductility. Increases of over 50% may be obtained in the Charpy values when compared to the as-cooled steel.

It is an object of the present invention to improve high toughness in high strength steel.

It is also an object of the present invention to provide improved steel with a microstructure of dislocated lath martensite with interlath retained austenite films.

It is further an object of the invention to improve both the strength and toughness of steel by grain refinement without complex and expensive heat treatments by a process of dynamic recrystallization devised by hot rolling and cooling sufficient for commercial hot rolling mills.

It is yet another object of the invention to provide a tough steel useful in the manufacture of armored plates.

It is yet another object of the invention to provide an improved steel useful in the mining, agricultural and general structural industries.

These and other objects may be achieved in part by controlled rolling and finish cooling, however, for many applications the desired properties may be attained without subsequent quench and temper treatments.

DETAILED DESCRIPTION OF THE PREFERRED EMBODIMENTS

Figure 1:
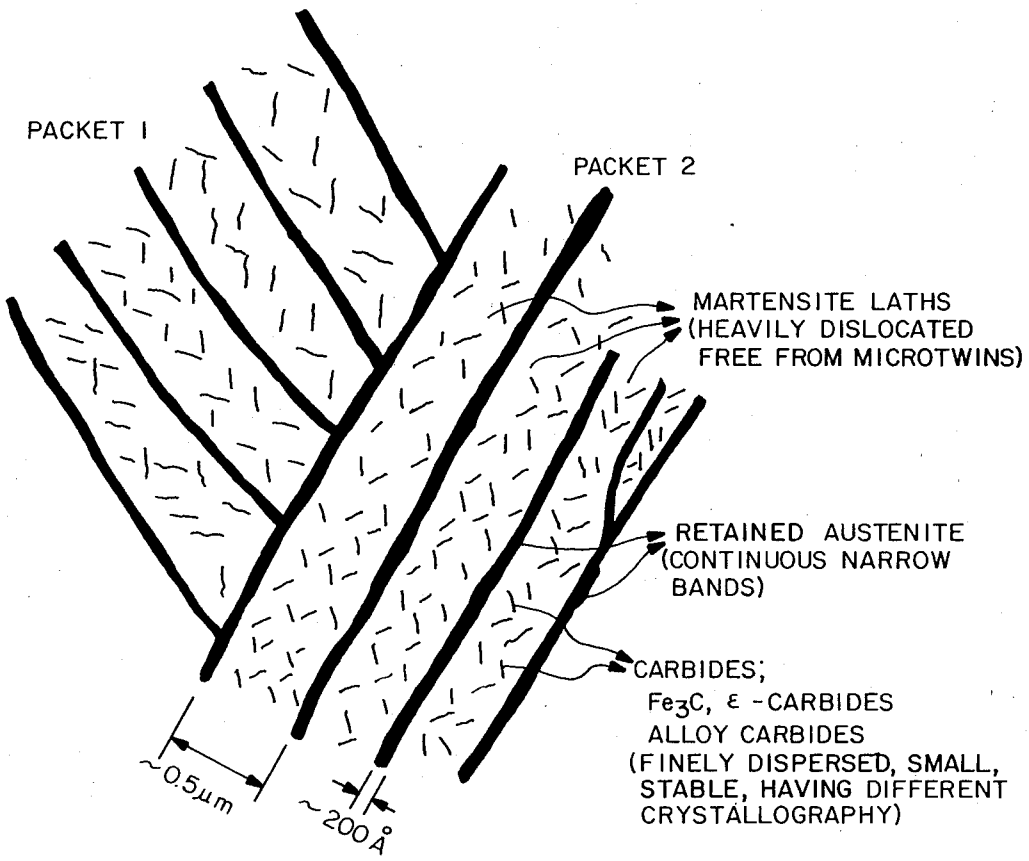
FIG. 1 is a schematic representation of the microstructure of the alloy steel of the present invention.

Briefly described, the present invention relates to a high-strength, tough alloy steel of a particular chemical composition and microstructure. The steel includes about 0.1 to 0.4 weight % carbon, 1 to 13 weight % chromium and 1 to 3 weight % manganese with or without minor additions of nickel and microalloying elements such as molybdenum, niobium, vanadium, and the like.

In a conventional processing treatment known in the art, steel alloy is heated into the stable austenitic range in order to dissolve the carbides present therein, and is then quenched, either by air cooling or oil quenching to form a microstructure consisting of lath martensite (which is predominantly in the dislocated form) separated from each other by thin films or bands of retained austenite. The laths have dispersed therein autotempered carbides, the degree of autotempering increasing as the cooling rate of the alloy decreases. This microstructure has heretofore been described as being the ideal microstructure to impart both high strength and high toughness to the alloy, as a result of the continuous films or bands of retained austenite. Such a microstructure is obtainable in the as cooled steel itself; it does not, however, have the high-impact toughness of the steel obtained by the process of this invention.

This improvement in high-impact toughness is attributable to the beneficial and unexpected effects of controlled rolling and may be achieved without subsequent tempering of the steel. Further increase in toughness values are, however, attainable by tempering, e.g., at 200°–250° C. as is shown in Table I.

The controlled rolling steps (b) and (d) in the method of the present invention involves the controlled deformation of the steel at a suitable temperature. Thus, the rolling temperature should be higher than the recrystallization temperature, which is usually in the range of 850°–900° C. If the steel is deformed at a temperature higher than this, spontaneous recrystallization occurs. This effect is known as dynamic recyrstallization, and is almost entirely independent of time because it takes place within a matter of seconds. The degree of deformation during the controlled rolling step according to the present invention must be sufficient to produce strained regions around all the grains, which means a reduction of not less than 30% in surface area, usually 30–40%. Deleterious properties may be obtained if the rolling is too light and/or if the rolling temperatures exceed about 1150° C. or drop below about 900° C. These limits may vary slightly, depending on the exact composition of the steel.

The preferred rolling steps used in accordance with the invention are as follows: the steel is heated to 1140° C. and is held there for a shorter duration of time than in the conventional treatment (which is 1 hour at 1100° C. for each inch of the slab). Then the steel is rolled at 1100° C. with a deformation of 30–40% at this temperature and air cooled or water or oil quenched following the deformation.

The following is a detailed theoretical description of the sequence of events which is believed to occur during controlled rolling, however this description is not intended to limit the invention in any way.

When steel is austenitized, it reaches a state of equilibrium characterized by a homogeneous austenite composition with a particular grain size. During the first rolling step, the individual grains are deformed and strain energy is stored in the deformed grains. Since the deformation is being carried out at a temperature higher than the recrystallization temperature, the grains spontaneously recrystallize. This spontaneous recrystallization starts at the grain boundaries and thus the deformed grains are replaced by a new set of grains whose size is smaller than that of the original grains. Prolonged holding at the high rolling temperature can cause undesirable growth in the size of the grains. This growth is avoided by quenching quickly to 950° C. At this temperature, the steel is again deformed and the whole sequence of events described above occurs again. However, in this case, since the starting grain size is now smaller (and hence, the grain boundary area greater) there are more centers where new grains can nucleate during the dynamic recyrstallization and, thus, a much finer grain size is produced than in the first cycle. The steel is then cooled and thus no further growth of the recrystallized grains occurs. On cooling, the austenite transforms into about 95% autotempered lath martensite surrounded by about 5% untransformed austenite films. This martensite is also refined, consisting of packets whose size depends upon the prior austenite grain size.

By this process, the desired microstructure is obtained concurrent with a fine grain size. These two phenomena together produce the large increase in impact toughness of the present steel. The cooling rate is determined by the composition of the steel. Thus, for leaner compositions, oil or a hot water quench is needed, but for the higher alloy content steels air cooling (normalizing) is sufficient.

One feature of the invention is that the carbon content is balanced in conjunction with chromium and manganese to sustain the microstructure and the hardenability. Contrary to the common belief that the addition of large amounts of substitutional alloying elements will lead to a preponderance of twinned martensite, the present invention exhibits only a small fraction of the microstructure to be of the twinned variety. This is more than compensated for by the known role of chromium in imparting excellent corrosion and oxidation resistance at contents above about 8%. In addition, chromium is an inexpensive alloying element. The elimination of tempering for many applications, e.g., mines, plates, rounds, chains, is a further cost benefit as well as being fuel efficient.

Referring to FIG. 1, the overall microstructure of a sample of steel of the present invention is schematically represented. As shown, it consists of, in three dimensions, a complicated mixture of packets containing laths of martensite surrounded and separated by very thin films of retained austenite. A large volume fraction of austenite is not necessary in order to impart high toughness to the steel since it is the connectivity of the austenite films that appear to be an important criterion.

Figure 2B:
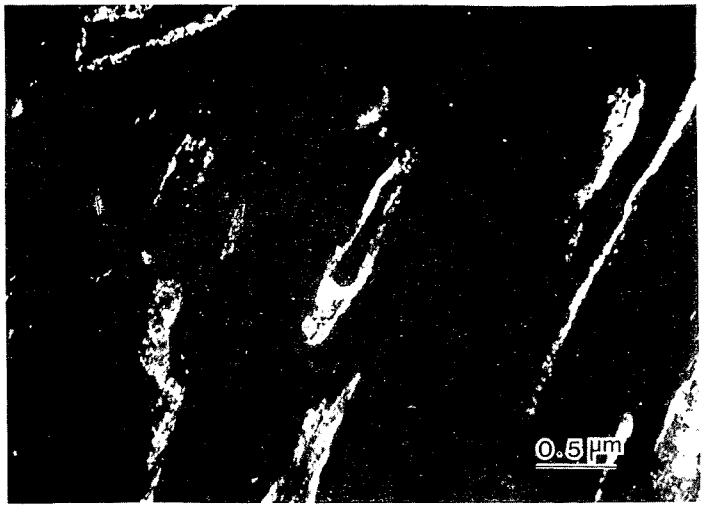
FIG. 2*a* through 2*c* is a set of transmission electron micrographs (TEM)—bright and dark fields—showing the dislocated lath structure of the martensite crystals and the continuous films of the inter-lath retained austenite of steel in accordance with the present invention; and an electron diffraction pattern of the same material proving that the microstructure consists of dislocated lath martensite crystals separated by continuous films of austenite.
Figure 2A:
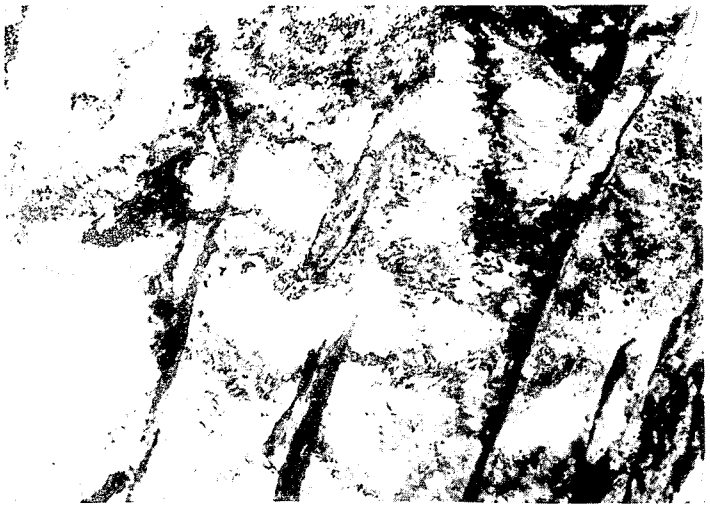

Referring to FIG. 2, there are shown transition electron micrographs of alloy steel according to the present invention (iron, 0.2% carbon, 10% chromium, 1% manganese) showing the dislocated lath structure of the martensite crystals and the continuous inter-lath retained austentite on TEM bright (FIG. 2*a*) and dark (FIG. 2*b*) fields.

Figure 2C:
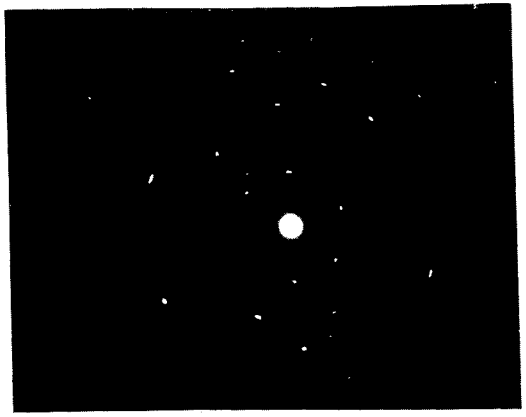

FIG. 2*c* is an electron diffraction pattern of the same material proving that it consists of dislocated lath martensite crystals separated by continuous films of austenite.

Figure 3A:
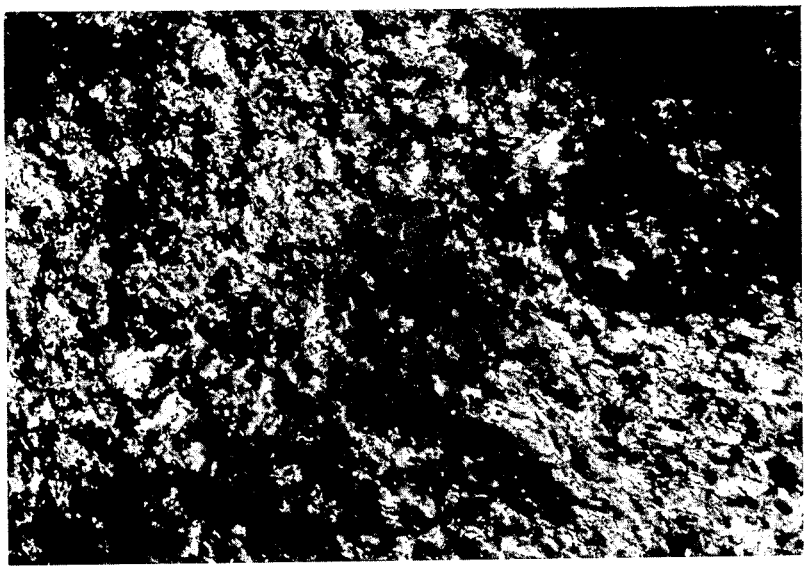
FIG. 3*a* through 3*b* is a set of bright and dark field TEM depicting the carbine distribution in steel in accordance with the present invention caused by the autotempering of the carbon saturated martensite.
Figure 3B:
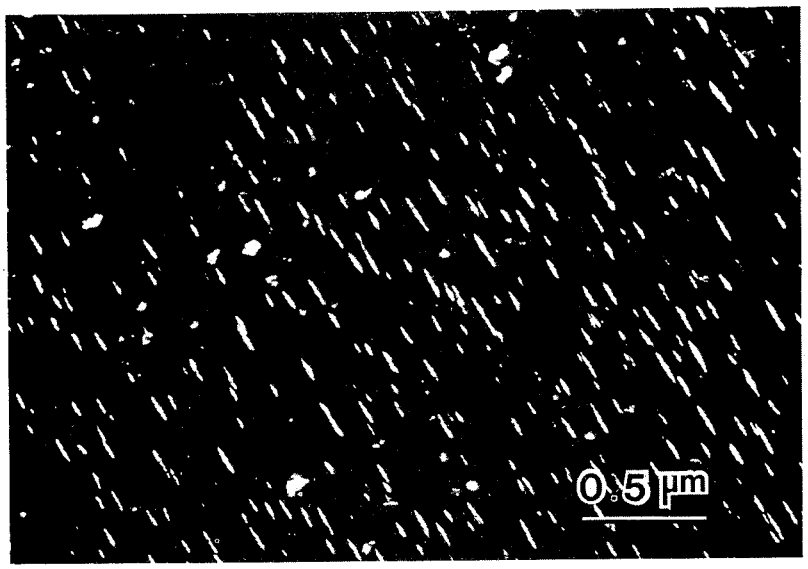

Referring to FIG. 3, by controlling the composition of the steel and the colling rate, a considerable degree of autotempering occurs as the steel is cooled to room temperature. This autotempering phenomenon is another reason for the high toughness, even though there is no significant drop in the strength of the steel. The degree of autotempering decreases as the cooling rate increases. The nature of these autotempered carbides is shown in transition electron micrographs in FIG. 3(*a*) (bright-field contrast) and FIG. 3(*b*) (dark-field contrast).

This present invention provides steel, improved by the beneficial effects of controlled rolling and cooling in comparison with the heretofore conventional treatments. The ultrafine grain size of the prior austenite leads to a refined packet size and distribution of the composite phases in the microstructure. This total effect results in superior strength and toughness combinations when compared to existing structural steels.

Figure 5:
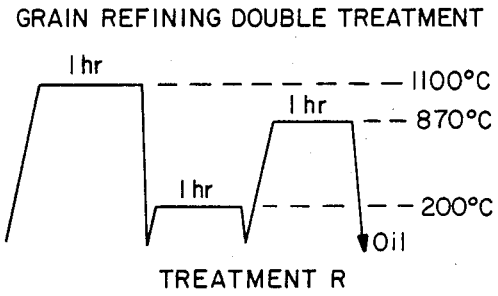
FIG. 5 shows cyclic quench and temper treatment to achieve grain refinement known in the art.
Figure 6:
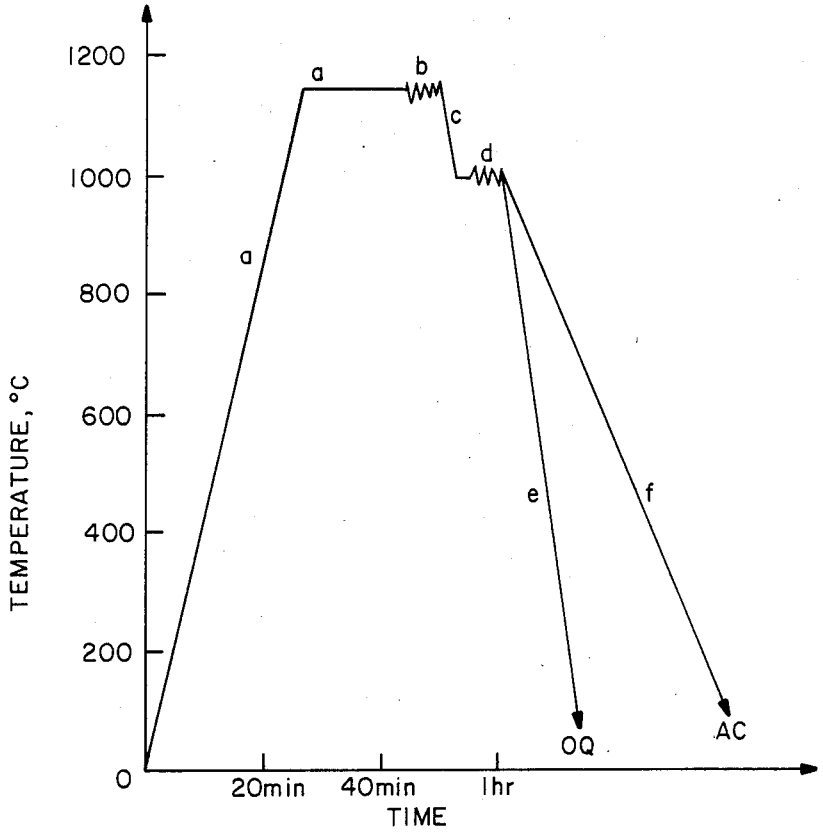
FIG. 6 depicts the controlled rolling process employed as the processing technique of the present invention.

A preferred enbodiment of the present invention is illustrated in FIG. 6, which can be compared to the less efficient multiple thermal treatments for grain refinement known in the art as shown in FIG. 5.

Referring to FIG. 6, the steel is first heated (step a) to about 1140° C. for 45 minutes so that it can be rolled at 1100° C. In the first pass (step b) the main purpose is to break down the original microstructure and bring about a first stage of grain refinement. As a result of this pass, the ingot is also made chemically homogeneous, since the deformation enhances complete diffusion of the alloying elements. The reduction should be such that there is uniform deformation of the steel, whereby a uniform grain size is obtained. Thus, reductions of less than 10% must be avoided, since this will cause a non-homogeneous deformation leading to a non-homogeneous grain size distribution and uneven grain growth. Reductions of from 30–60% can be achieved in a hot mill. Following this first stage of grain refinement, the steel is cooled to 950° C. (step c) and is rolled (step d) at that temperature. An optimized reduction of 45% was used in this case, but a greater degree of reduction can be imparted to the steel depending upon the roll capacity and also upon the proximity to the recrystallization and/or the phase transformation temperature. In no case, however, may the rolling be carried out below the recrystallization temperature. Hence the processing temperature is limited at its lower end by the recrystallization and/or transformation temperature and at its upper end by the temperature leading to the formation of delta ferrite, which is deleterious to the properties of the steel. Both of these factors depend upon the compositin of the steel.

Subsequent to the rolling, the steel is quenched into water or agitated oil (step e) or is cooled in air (step f) depending upon the properties required.

Figure 7:
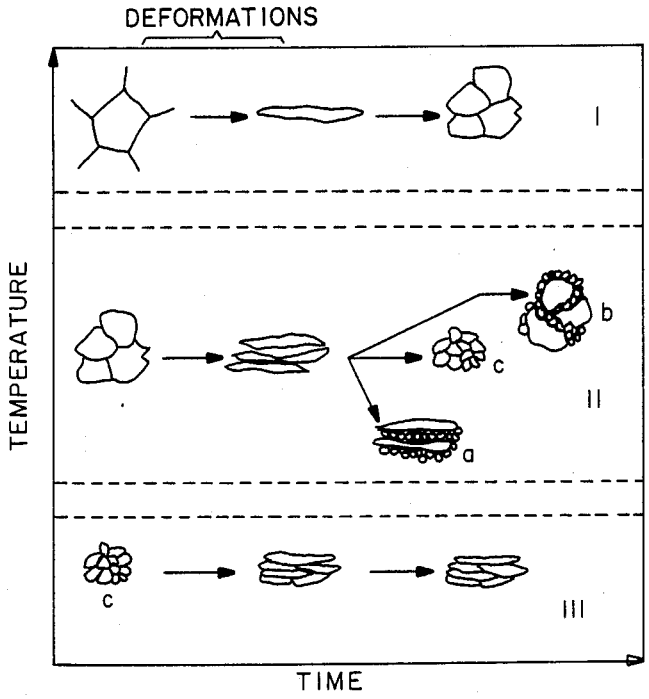
FIG. 7 schematically represents the process of grain refinement according to the present invention by dynamic recrystallization during controlled rolling.

Referring to FIG. 7, there is schematically shown the sequence of events during the controlled rolling process. The controlled rolling in the temperatue range of 900°–1100° C. forms deformed grains, which spontaneously recrystallize to smaller grains (I). The rolling at 950° C. the smaller grains are deformed, and nucleate during dynamic crystallization to form finer grains (II*c*). Upon cooling autotempered lath martensite is formed surrounded by untransformed autensite films (II*a*, II*b*). Finish rolling may further temper the untransformed grains (III).

Figure 8:
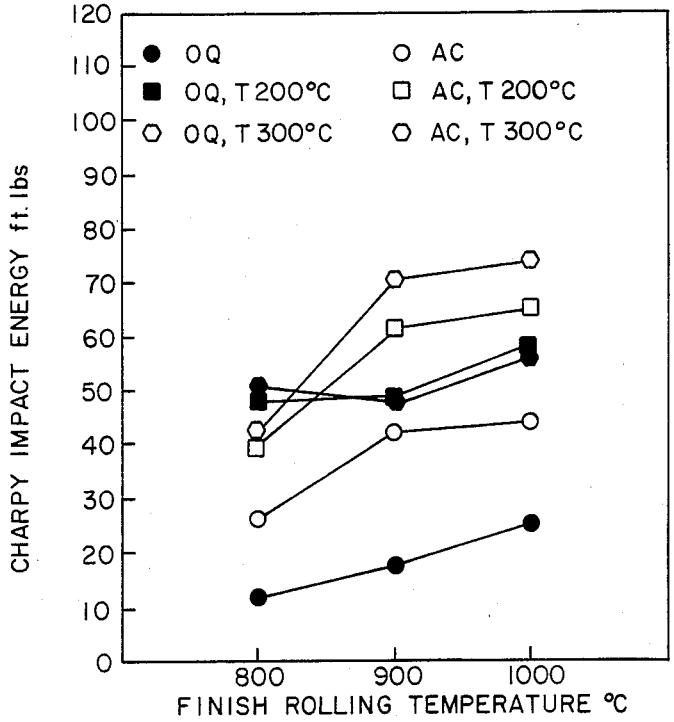
FIG. 8 is a graph showing the effect of the finish rolling temperature on the impact properties, when the first rolling temperature was 1100° C. The values for the air cooled (AC) and the oil quenched (OQ) samples in the as quenched, quenched and 200° C. temper (T200C) and quenched and 300° C. temper (T300C) conditions are recorded.

Referring to FIG. 8, the Charpy impact properties of steel having the composition described in connection with FIG. 2 after a controlled rolling treatment are shown. In this plot the dramatic effect of the finish rolling temperature is illustrated. Thus, and as shown in FIG. 8, while finish rolling temperature about 900° C. do not produce poor toughness, temperatures below 900° C. may lead to poor toughness for some compositions. Other features shown in FIG. 8 are: (1) the relatively high value of the impact toughness of the air cooled (AC) (OQ represents oil quenching) sample, even in the as-cooled condition; (ii) the significant increase in toughness upon tempering at 200°–300° C.

Figure 4:
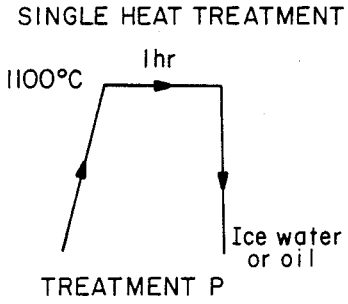
FIG. 4 is a schematic representation of the conventional treatment known in the art.
Figure 9:
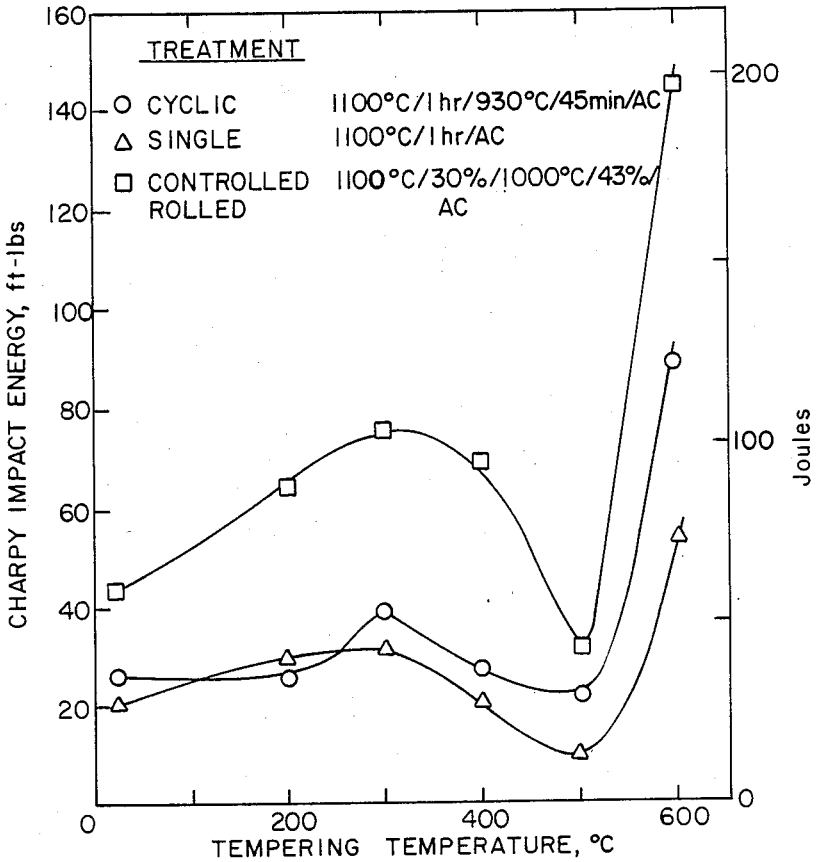
FIG. 9 is a graph comparing the Charpy impact properties of controlled rolled steel with the single and double thermal treatments.

FIG. 9 is a graph showing the high toughness of the present steel (composition as recited in connection with FIG. 2) compared to steel treated by a cyclic process (FIG. 5) or single treatment process (FIG. 4). In FIG. 9, the impact properties of the same steel are compared for three different treatments: (i) the single thermal treatment (described in FIG. 4); (ii) the cyclic treatment (described in FIG. 5); and (iii) process of the present invention. In all cases the steel was air-cooled (AC). The controlled rolling process clearly gives higher impact properties for all tempering temperatures. For all tempering temperatures, the Charpy values in the controlled rolled condition are almost twice that of the other two treatments.

Figure 10:
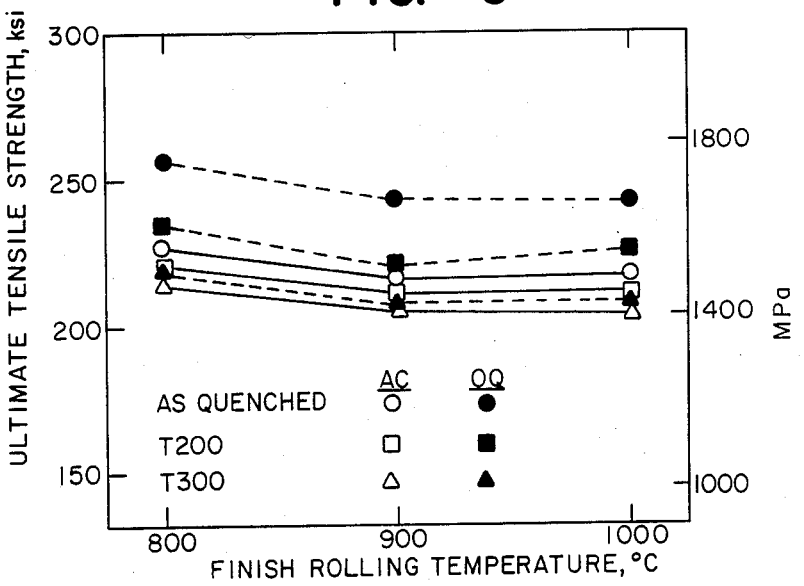
FIG. 10 is a graph of the effect of finish rolling temperature on the ultimate tensile strength and yield strength of steel, when the first rolling temperature was 1100° C. The conditions of temperature the same as in FIG. 8.

Referring to FIG. 10, the strength properties of the steel (composition as recited in connection with FIG. 2) are plotted as a function of the finish rolling temperature. This graph compares the properties for three different conditions of temper, for the air-cooled and the oil quenched samples. Comparing the oil quenched steel and the air cooled steel in the 300° C. temper, the air cooled steel has almost the same strength as the oil quenched steel, although the oil quenched steel has a toughness value about 30% lower than the air cooled steel (see FIG. 8). These results, together with the facile processing route of the present invention, make the controlled rolling plus air cooling an advantageous overall process.

Figure 11:
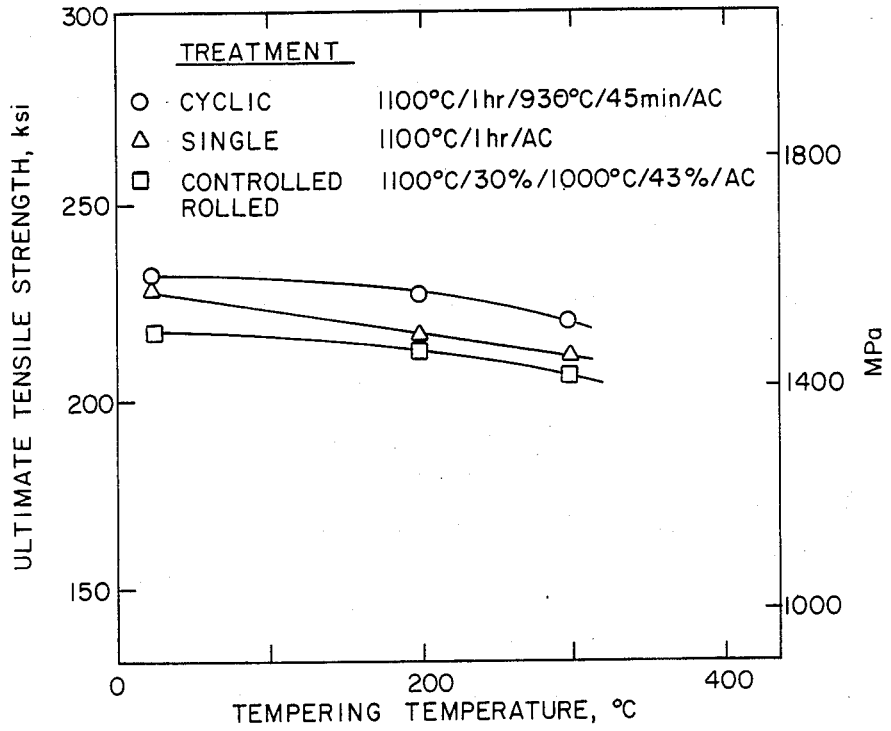
FIG. 11 is a graph of the strength properties of controlled rolled steel with those of the single and double thermal treatments.

FIG. 11 shows how the strength of the controlled rolled steel (composition as recited in connection with FIG. 2) compares with those of the single and double treatments. The strength levels are almost the same and hence no significant loss in strength is observed using controlled rolling.

Figure 12:
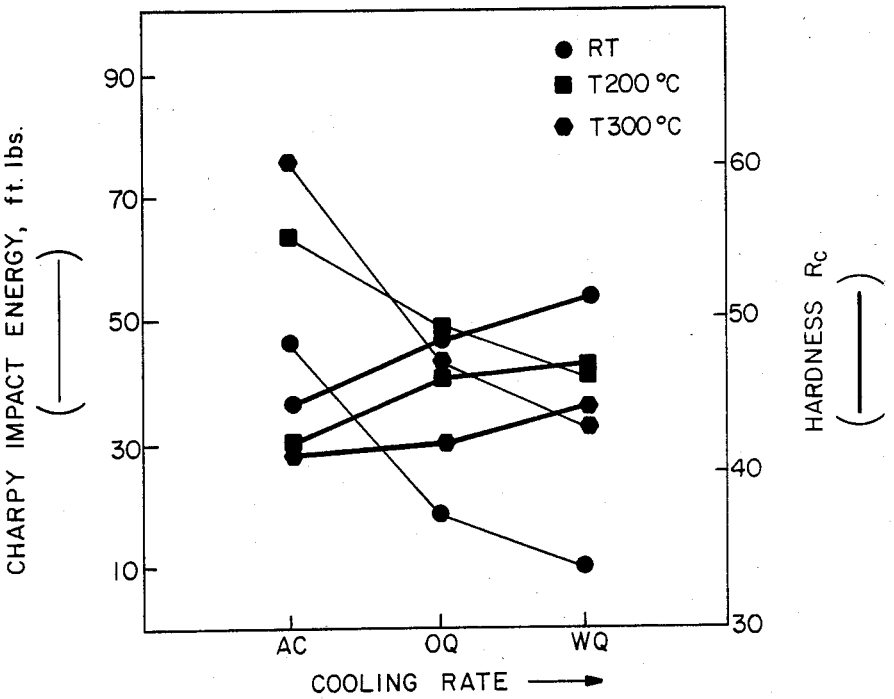
FIG. 12 is a graph illustrating the effect of cooling rate on on the Charpy impact energy and Rockwell hardness (note the reverse trend).

Referring to FIG. 12, the data shows that the cooling rate after controlled rolling has a strong effect on the mechanical properties. In FIG. 12, the Charpy values and the Hardness values for steel having the composition as recited in connection with FIG. 2 are plotted for the three different cooling rates, i.e., air cooling, oil quenching and hot water quenching (WQ). As the quenching rate increases from air cooling to water quenching, the impact properties decrease, but the hardness value increases. This trend might be attributed to the greater preponderance of twinned martensite as the cooling rate is increased.

Representative properties of the present steel are summarized in Table I.

TABLE I

| | COMPARISON OF PROPERTIES | | | | | |
|---|---|---|---|---|---|---|
| Alloy and Treatment | Tensile Strength ksi | Yield Strength ksi | Charpy Impact Strength ft. lbs. | Hardness $R_C$ | $K_{IC}$ ksi. in$^{\frac{1}{2}}$ | % Elongation |
| 3% Cr: 1100°OQ | 274.4 | 205.3 | 16.1 | 49.2 | — | 8.1 |
| controlled rolled, OQ | | | 31.6 | 49.0 | | |
| 8% Cr: 1100°OQ | 226.3 | 182.7 | 20.8 | 43.8 | — | 10.3 |
| OQ, T200 | 218.7 | 178.8 | 45.6 | 44.0 | — | 11.9 |
| controlled rolled, OQ | 223.2 | 175.0 | 35.9 | 45.0 | 217.2 | 14.0 |
| T200 | 219.8 | 180.2 | 50.7 | 43.5 | 276.1 | 15.2 |
| 10% Cr: 1100°OQ | 243.8 | 201.4 | 20.9 | 47.5 | — | 10.0 |
| OQ, T200 | 228.7 | 182.3 | 47.3 | 47.3 | — | 13.8 |
| controlled rolled, OQ | 240.3 | 198.2 | 29.1 | 47.7 | 161.4 | 13.5 |
| T200 | 238.2 | 180.3 | 68.1 | 44.5 | 287.5 | 16.2 |
| 12% Cr: 1100°OQ | 282.6 | 207.1 | 15.2 | 50.5 | — | — |
| OQ, T200 | 227.2 | 201.3 | 42.3 | 50.1 | 144.6 | 12.9 |
| controlled rolled OQ | 280.2 | 205.4 | 18.9 | 49.0 | — | 9.8 |
| T200 | 257.2 | 199.0 | 47.3 | 45.3 | — | 14.2 |

OQ = oil quench
T = tempering temperature

We claim:

1. A method of forming a high strength, tough alloy carbon steel, said method comprising the steps of:

(a) heating a steel alloy comprising 0.1 to 0.4 weight % carbon 1 to 3 weight % manganese and 1 to 13 weight % chromium and the remainder of iron to a temperature above the austenite transformation temperature to form a stable, homogeneous austenite phase;

(b) control rolling, at a temperature in the range of about 900° C. to 1100° C. at which dynamic recrystallization of said austenite occurs, said alloy with a reduction of not less than 30% in area to form a microstructure of uniformly dispersed ultrafine austenite grains;

(c) rapidly cooling the rolled steel from step (b) to 950° C.;

(d) rolling the cooled steel from step (c) with a reduction of not less than 40% in area to further reduce the size of said grains; and (e) quenching the rolled steel from step (d) in liquid or air to produce high strength steel characterized by a microstructure of fine packets of dislocated lath martensite surrounded by stable films of austenite and having properties characterized by a room temperature Charpy impact strength of at least about 40 ft/lbs, a plane strain fracture toughness ($K_{Ic}$) of at least about 80 ksi-in.$^{\frac{1}{2}}$ and a Rockwell C-scale hardness of at least about 46 and superior wear resistance.

2. A method according to claim 1 wherein in said step (c) said liquid is oil or water.

3. A method according to claim 1 wherein in said step (b) said reduction is 30–40%, and said reduction in said step (c) is 30–40%.

4. A method according to claim 1 further comprising the step of (f) tempering said high strength steel at a temperature up to about 300° C.

5. A method according to claim 1 wherein said steel alloy further comprises a microalloying amount of a metal selected from the group consisting of nickel, molybdenum, niobium, vanadium, and combinations thereof.

6. A product produced by the method of claim 1.

7. The product produced by the method of claim 5.

* * * * *